United States Patent [19]

Hoese et al.

[11] 4,236,858

[45] Dec. 2, 1980

[54] SHEET COLLATING AND STACKING DEVICE

[75] Inventors: Frank Hoese, Grossinzemoos, Fed. Rep. of Germany; Gerd von Aschwege, New York, N.Y.; Herbert Bernardi, Arget, Fed. Rep. of Germany

[73] Assignee: G.A.O. Gesellschaft für Automation und Organisation mbH, Fed. Rep. of Germany

[21] Appl. No.: 912,216

[22] Filed: Jun. 5, 1978

[30] Foreign Application Priority Data

Jun. 10, 1977 [DE] Fed. Rep. of Germany ..... 2726130

[51] Int. Cl.[3] ..... B65G 1/00

[52] U.S. Cl. ..... 414/331; 271/294; 414/787; 270/58

[58] Field of Search ..... 414/331, 787, 47; 271/173, 64, 213, 63, 292, 279, 278, 293, 294, 295; 270/58; 211/164, 1.5; 53/157, 537, 152; 246/2 S

[56] References Cited

U.S. PATENT DOCUMENTS

| | | | |
|---|---|---|---|
| 1,607,995 | 11/1926 | Marcuson | 270/58 |
| 2,136,880 | 11/1938 | Honigman | 271/63 R X |
| 2,589,676 | 3/1952 | Crissy | 270/58 X |
| 2,876,008 | 3/1959 | Mestre | 271/213 X |
| 3,096,089 | 7/1963 | Swenker et al. | 271/173 |
| 3,106,706 | 10/1963 | Kolanowski et al. | 246/2 S X |
| 3,160,295 | 12/1964 | Roark | 414/331 |
| 3,613,911 | 10/1971 | Walchhuter | 414/331 |
| 4,083,550 | 4/1978 | Pal | 270/58 X |

*Primary Examiner*—Stephen G. Kunin
*Assistant Examiner*—Edmond G. Rishell, Jr.
*Attorney, Agent, or Firm*—McGlew and Tuttle

[57] ABSTRACT

A distributing apparatus for collecting information carrying sheets of paper and the like comprising, a plurality of trays which are each pivotally mounted to a succeeding tray in a stack thereof to form a magazine of trays with a locking device for locking each tray to an adjacent tray in the magazine so that the magazine can be transported as a unit. The magazine is supplied to a guide which has a curved portion adjacent a loading station. The curved portion of the guide causes adjacent trays to pivot apart from each other and open after their respective locks have been unlocked so that one or more information carrying sheets can be supplied to each of the now opened trays. A driving mechanism in the form of rotating rollers having pins extending therefrom is engageable with angle portions extending from the trays for moving the trays along a feed path and along the guides. After the trays have been supplied with information carrying sheets, they are again pivoted toward each other through the action of the guide and locked with each other to again form the closed magazine which is transportable as a unit.

16 Claims, 8 Drawing Figures

56
71
72
70
63
29 b
69
54a
24a
53
35a
54 b
51b
51a
41
49
49
55a
23
54c
45
55 b
29a
19
29b
20
50
50
62
21
29 b
54 d
52 b
29a
60 a
52a
58
64
65
59
66
40
38
24c
24 b
64
60b
59
20
21

43
61
36

SHEET COLLATING AND STACKING DEVICE

FIELD AND BACKGROUND OF THE INVENTION

The present invention relates in general to material handling equipment and, in particular, to a new and useful distributing apparatus for collecting informatin carrying sheets in numbered trays which are mounted together to form a magazine. The trays are successively guided past a loading station where they receive the information carrying sheets.

The present invention relates to a distributing apparatus as set forth in the preamble of claim 1.

A distributing apparatus of the above kind is known, for example, from U.S. Pat. No. 2,589,676. In that apparatus, the individual trays, which are connected with a conveyor chain via forked supports and united in an endless magazine, can be successively and automatically loaded with sheets of paper and manually emptied at the same point in the conveyor chain. The individual trays are opened by running the conveyor chain over a small-radius gear wheel. The apparatus can be used, for example, to collect in the trays different pages of several books.

Once the magazine of the distributing apparatus described has been loaded, it must first be emptied before it can be reloaded. Since, in addition, no record is kept of the deposited sheets, the sheets removed from the trays must either be processed immediately or deposited again and marked for subsequent processing. This requires much labor and becomes complicated when greater quantities of sheets have to be handled. In any case, however, the loading process must be interrupted in order to empty the trays.

Another disadvantage is that the magazine must be reset to its starting position before it can be reloaded.

SUMMARY OF THE PRESENT INVENTION

Accordingly, the object of the invention is to provide a distributing apparatus with the aid of which sheet-like information carriers can be collected in continuous succession in lockable and identifiable trays, the latter being united in a portable and identifiable magazine.

The distributing apparatus according to the invention and the associated magazine thus permit information carriers to be processed by a special technique wherein, for example, the information carriers sorted from different packets according to different criteria are collected in a fixed assignment to the packets by stacking the information carriers, which are continuously collected in packets and counted, in trays marked with numbers, and drawing up a record which shows the magazine and tray numbers, the number of deposited information carriers, and the criteria which have resulted in the deposition. Thus, the loaded, locked magazine can be filed together with the associated record and selectively processed at any time with the aid of the record.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

An embodiment of the invention will now be explained in more detail with reference to the accompanying drawings, in which.

DESCRIPTION OF THE PREFERRED EMBODIMENT

Figure 1:
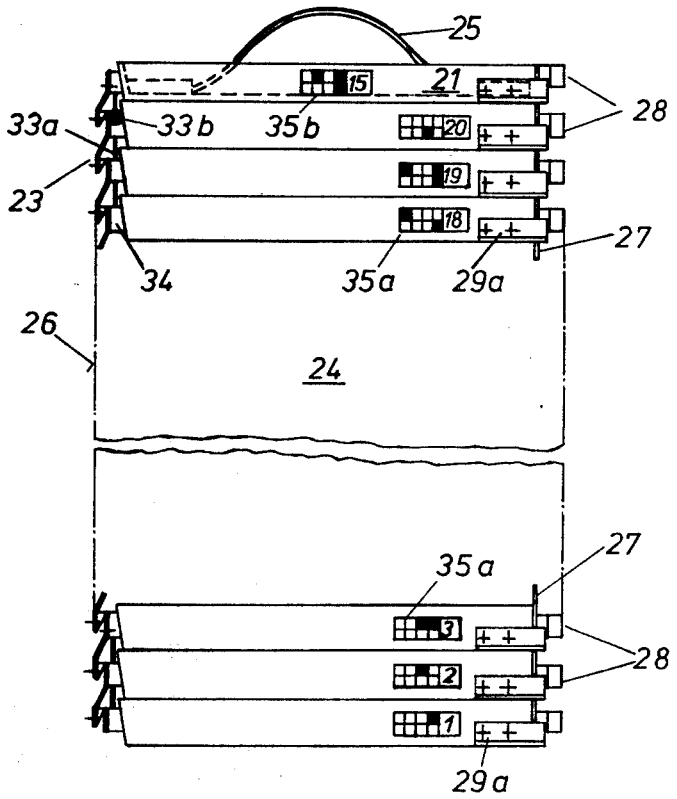
FIG. 1 is a front view of the closed magazine with the individual trays.
Figure 2:
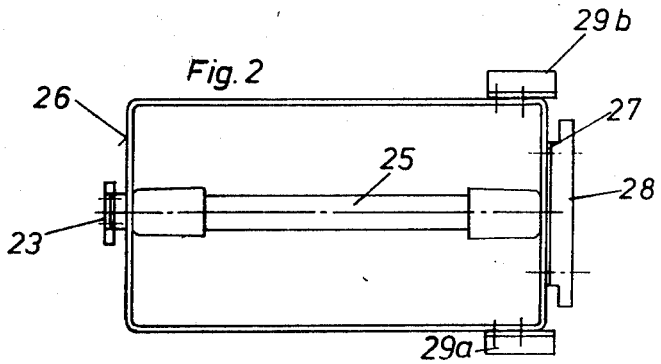
FIG. 2 is a top view of the magazine.

The magazine 24 shown in FIGS. 1 and 2 consists of 21 flat, rectangular trays 1 to 21 in which sheet-like information carriers are collected. The cover of each tray is formed by the bottom of the tray lying on top of it. The uppermost tray of each magazine, designated by the number 21, has a foldout handle 25, so this tray cannot be used to collect information carriers.

The individual trays of the magazine are interconnected by two elements. At the front end 26 of the magazine, a lock 23 attached to a distance piece 34 is provided at each tray. At the end opposite the front end, a flexible tape 27 extends along the whole length of the magazine and is firmly connected with the trays by means of the T-guide portions 28, whose function will be explained below. Furthermore, each tray has, at the rear of its sidewalls—related to the front end 26—, near the guide portions 28, two engaging angles 29*a*, 29*b* which permit the magazine to be transported through the distributing apparatus. Affixed to the sidewalls are adhesive labels 35*a*, 35*b* printed with the tray numbers 1 to 21 and, on the 21st tray, with the magazine number—in FIG. 1 the number 15, for example. As shown schematically in FIG. 1, these labels also contain the coded form of the tray or magazine number necessary for automatic identification.

To increase the lateral stability of the closed magazine, each distance piece 34 has a guide pin 33*a* therein which extends into a hole 33*b* of the respective subsequent distance piece. The construction of the locks and the interaction of the individual parts are shown in detail in FIGS. 7 and 8 and will be explained below with the aid of these figures.

The operation of the distributing apparatus will now be explained with the aid of FIGS. 3 and 4.

Figure 3:
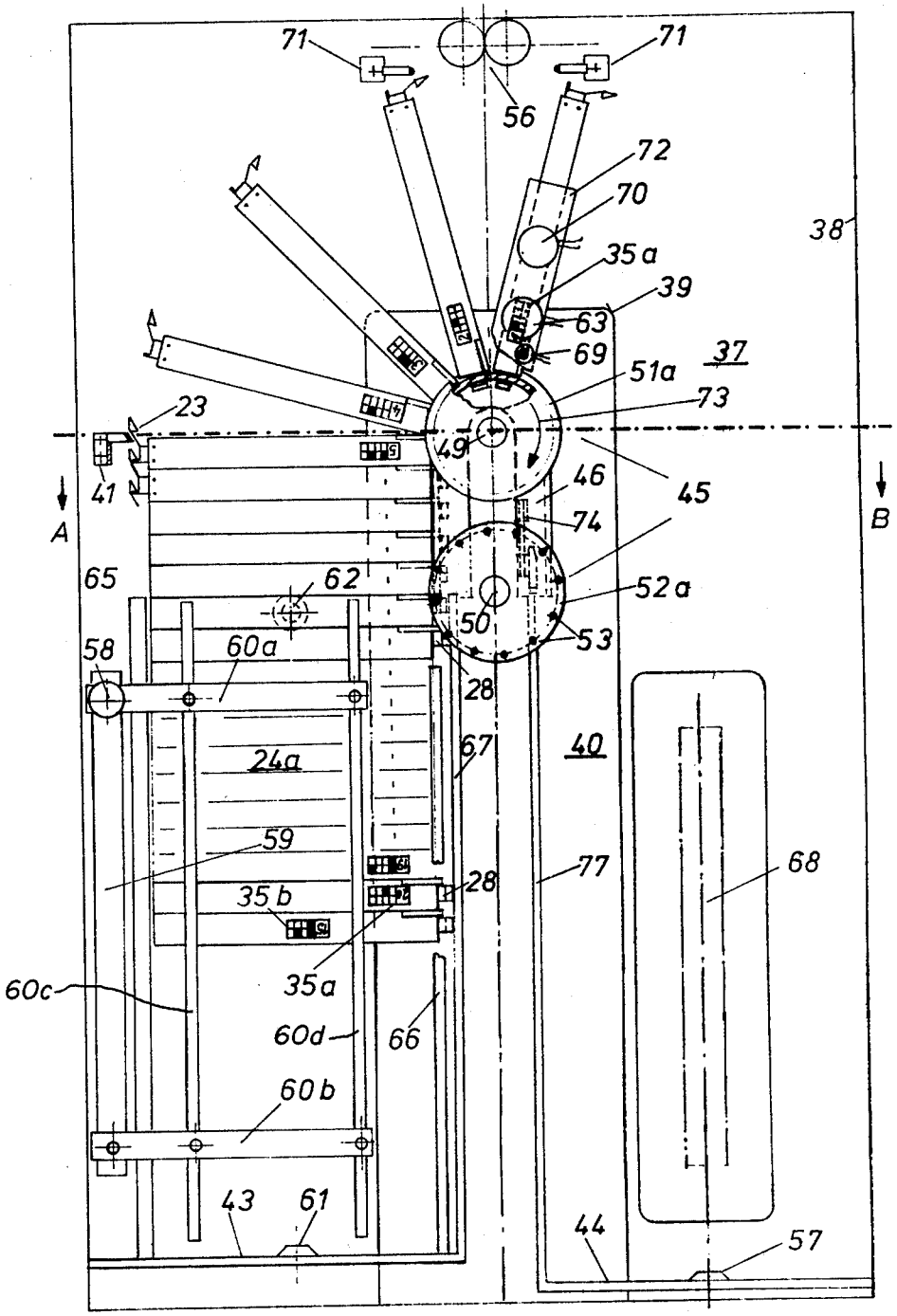
FIG. 3 is a front view of a distributing apparatus with a partly closed, partly fanned-out magazine.
Figure 4:
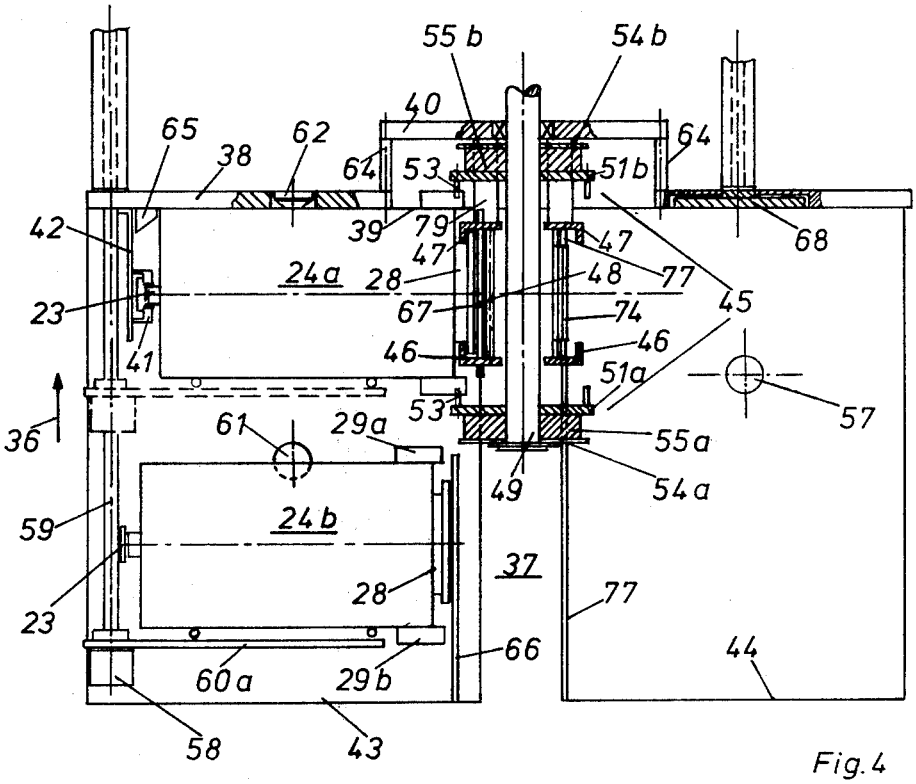
FIG. 4 is a section taken along line A–B of FIG. 3 with an additional magazine in the waiting position.

While FIG. 4 shows two magazines one of which—the magazine 24*a*—is in the distributing apparatus, while the other—the magazine 24*b*—is in the waiting position, FIG. 3 shows only the partly closed, partly opened-up magazine 24*a* for the sake of clarity.

In the following description it is assumed that no magazine is in the distributing apparatus.

At the beginning of the distributing process, under conditions to be explained below, a magazine 24*b* being in the waiting position on a feed table 43 (FIG. 4) is pulled, by means of a pull-in mechanism 59, into the distributing apparatus 37 in the direction indicated by an arrow 36. Pull-in mechanism 59 comprises a pair of shafts which are movable in the direction of arrow 36 and which carry arms 60*a* and 60*b* which carry cross rods 60*c* and 60*d* for embracing and pushing magazines on feed table 43 (at 24*b*) to distributing apparatus 37 (at 24*a*) in FIG. 4. A driving system 45 then lifts the magazine and guides the guide portions 28 of the latter into two U-shaped guide strips 46, 47. After being unlocked by an unlocking mechanism 41, the individual trays open up like a fan—in accordance with the curvature of the guide strips—and are moved, step by step, past a loading device 56 (FIG. 3). To be loaded with information carriers, each tray stops under the loading device in the position taken up in FIG. 3 by tray number 1, for example. After the tray has been loaded with the information carriers intended for this tray, and after its number on the label 35*a* has been identified by means of a diode matrix 63, which will be explained below, the magazine is moved on until the next tray, i.e. the tray with the number 2, reaches the position of the tray number 1 shown in FIG. 3. In this manner, all trays pass the loading station 56 one after the other. After 20 trays have moved past the loading station 56, the magazine number on the label 35*b* affixed to the 21st tray is determined with a diode matrix 70. Now that the whole magazine 24*a* has passed through the distributing apparatus and has been loaded with information carriers, it moves on to a delivery table 44, which is on an opposite side of driving system 45 from feed table 43, from where it is pushed out of the distributing apparatus by means of a delivery mechanism 68. The trays on table 44 are locked together automatically as they are stacked on table 44 by driving system 45. Together with the loaded magazine, as mentioned above, a record is delivered which may contain the following information:

the magazine number the tray numbers the number of information carriers deposited in each tray the criteria which have led to the deposition.

The loaded magazine can thus be processed together with the associated record immediately or at a later time.

When the magazine 24*a* still being in the distributing apparatus has reached a given level, the magazine 24*b* being in the waiting position follows automatically, so that the uppermost (first) tray of the following magazine 24*b* comes directly after the last tray of the magazine 24*a* being in the distributing apparatus. Thus, the distributing process is never interrupted.

Figure 5:
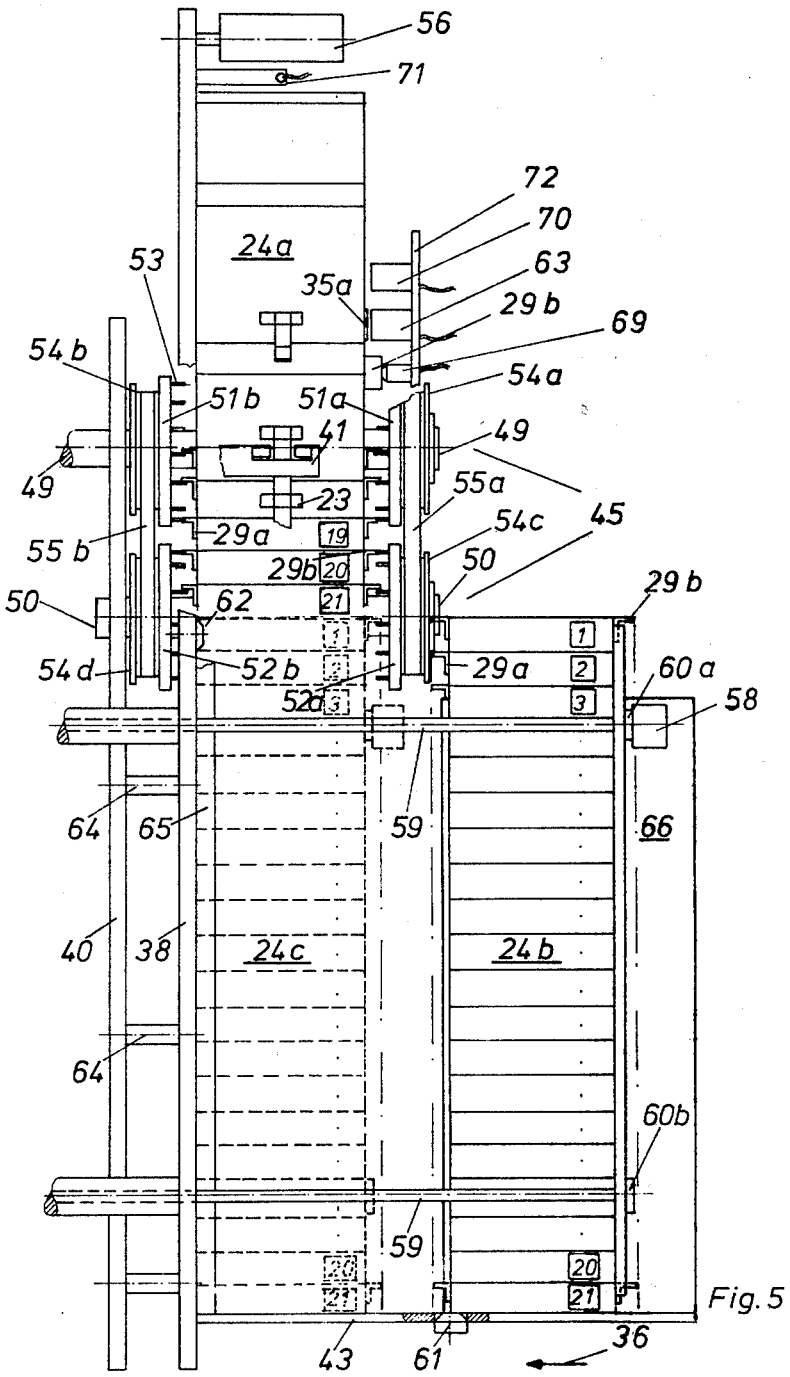
FIG. 5 is a side view of the distributing apparatus with an additional magazine in the waiting position.
Figure 6:
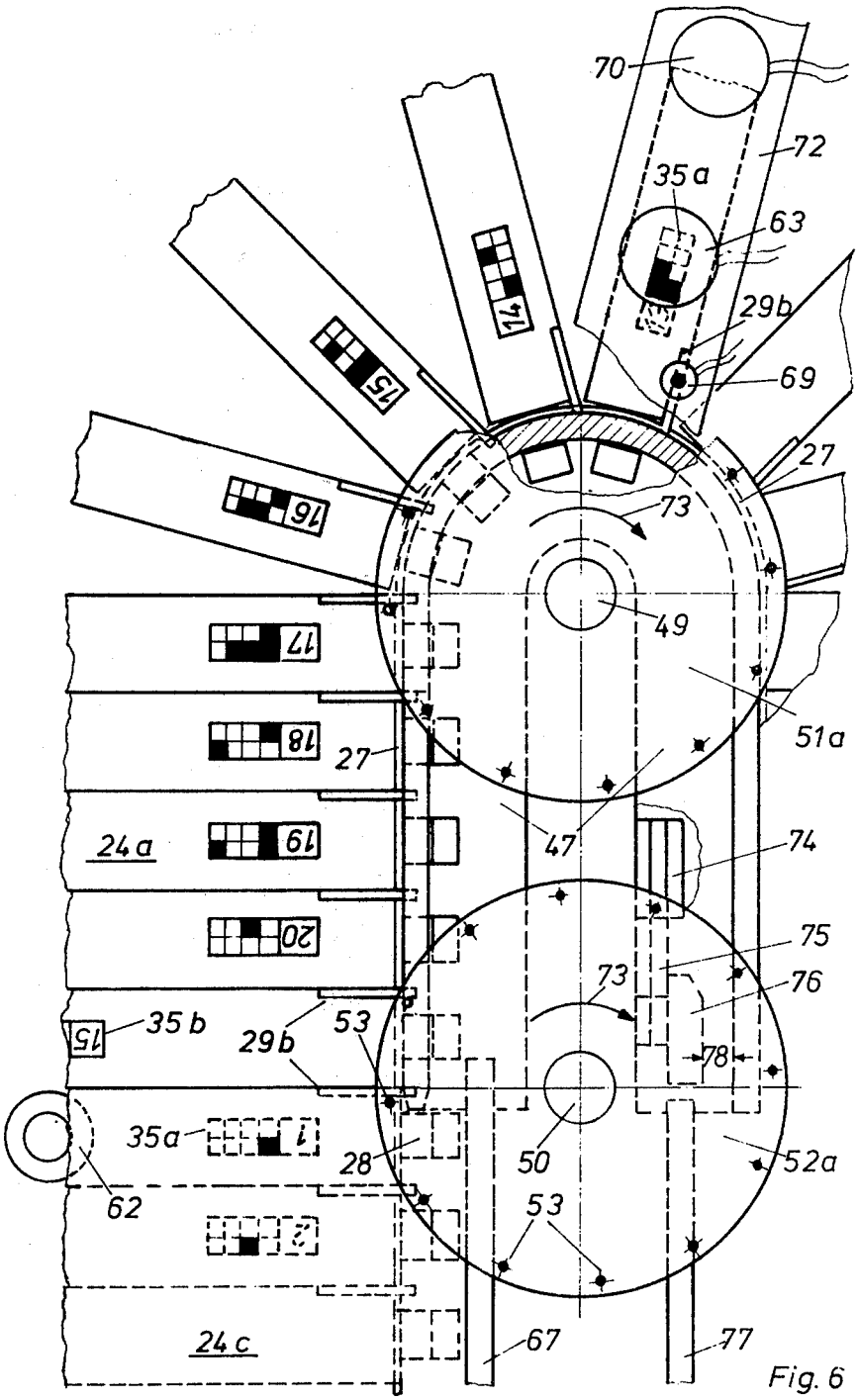
FIG. 6 is a partial view of the driving system of the distributing apparatus.

The distributing apparatus 37, in which the above-described operations are performed, is shown in detail in FIGS. 4 to 6. To illustrate how the magazines advance in continuous succession, three of them are shown in FIG. 5. One magazine, 24*a*, is in the distributing apparatus under the loading device 56; a second magazine, 24*c*—indicated by broken lines in FIG. 5—has just been introduced into the distributing apparatus, and a third magazine, 24*b*, is in the waiting position. In FIG. 6, the magazine 24*c* is also indicated by broken lines.

Before describing the operation of the distributing apparatus in detail, the most important elements of the apparatus will be explained.

As can be seen in FIGS. 4 and 5, the distributing apparatus includes two frame plates 38, 40 which are arranged one behind the other, separated by spacing strips 64, and have all working parts attached or pivoted thereto. On the side where the magazines are introduced, the feed table 43 is mounted at the lower end and near the left-hand side (FIG. 4) of, and perpendicular to, the frame plate 38. Near the right-hand side (FIG. 4)—the delivery side of the magazine—the delivery table 44 is mounted. Further components of the distributing apparatus are the driving system 45 and the guide strips 46, 47 mounted between two pairs of driving wheels 51*a*, 51*b* and 52*a*, 52*b* disposed one above the other.

Mounted in pairs on two drive shafts 49, 50 of the driving system 45 are the spaced-apart driving wheels 51*a*, 51*b* and 52*a*, 52*b* which all carry inwardly directed driving pins 53 evenly distributed along their circumferences and extending parallel to the drive shaft. The distances from the driving wheels 51*a* to 51*b* and 52*a* to 52*b* are chosen so that a magazine, including the two engaging angles 29*a*, 29*b*, fits widthwise between the driving wheels, as shown in FIGS. 4 and 5. The direct distance between the driving pins 53 on all driving wheels is equal to that between two successive engaging angles 29 at the magazine, so the feed force is evenly distributed among all driving pins being in engagement. Shafts 49, 50 are rotatably mounted to a smaller frame 40 and extend through opening 39 of the frame plate 38.

Mounted in front of each of the four driving wheels are gears 54*a*, 54*b*, 54*c* and 54*d* (FIGS. 4 and 5) with which the driving force is transmitted from the upper drive shaft 49, which is driven by a motor (not shown), via timing belts 55*a*, 55*b* to the lower drive shaft 50.

Located between the driving wheels are the L-shaped guide strips 46, 47, which are held apart by spacers 48, and whose opening is directed downwards to form a U-shaped guideway and to the feed and delivery tables 43, 44. Both strips are attached jointly to the frame plate 40 by means of spacing studs 79.

As clearly shown in FIG. 6, the guide strips 46, 47 begin about halfway up the driving-wheel pair 52*a*, 52*b*. After a straight portion which extends to the upper driving-wheel pair 51*a*, 51*b*, they describe a circular arc about the drive shaft 49 of the driving-wheel pair 51*a*, 51*b*.

The interaction of the guide strips 46, 47 and the driving system as well as the mechanical and electronic elements marking the path of the magazine from the waiting position via the feed table to the delivery table will be apparent from the following description of the operation of the distributing apparatus.

It is assumed that a magazine 24*a* is in the distributing apparatus 37, while a second magazine 24*b* is in the waiting position on the feed table 43 and ready to be pulled in, as shown in FIGS. 4 and 5.

By the magazine 24*b* in the waiting position, a switch 61 fitted in the feed table 43 is closed. This switch 61 is only closed by the magazine's long side facing the distributing apparatus. This ensures that the magazine has taken up the waiting position necessary for pull-in.

When, in addition, a switch 62 attached to the frame plate 38 approximately on a level with the lower driving-wheel pair 52*a*, 52*b* is opened because the last tray 21 of the magazine 24*a* located in the distributing apparatus is exactly one tray higher than the switch 62, as shown in FIG. 5, two conditions are satisfied which put the pull-in mechanism 59 in action. By means of cross members 60*a*, 60*b*, the magazine 24*b* is pulled from the waiting position into the apparatus. While being pulled into the distributing apparatus—in the direction indicated by the arrow 36—by the pull-in mechanism 59, which is operated by a pneumatic cylinder (not shown), the magazine 24b first slides along the front guide plate 66 standing upright on the feed table 43. Thus, the magazine 24b can be guided past the driving wheels 52a, 52b. The magazine then hits a positioning strip 65 attached to the frame plate 38. The bevel of the positioning strip 65—shown in FIG. 4 in a top view—imparts to the magazine a right-hand motion relative to the arrow 36, so the magazine moves with its upper guide portions 28 and the engaging angles 29a, 29b between the two lower driving wheels 52a and 52b. The magazine finally hits the frame plate 38 with its long side facing the distributing apparatus, and a rear positioning plate 67 with its guide portions 28, and is now located between the positioning plate 67 and the straight portion of the positioning strip 65 following the bevelled portion. In this position, the guide portions 28 of the magazine just introduced into the distributing apparatus and designated 24c in FIGS. 5 and 6 are exactly under the guide strips 46, 47, as indicated in FIG. 6 by broken lines. By the magazine 24c, which is also indicated by broken lines in FIG. 5, the switch 62 is closed again. Switch 61 is open, since there is no magazine in the waiting position. These states are utilized to turn the cross members 60a, 60b of the pull-in mechanism 59, which are indicated by broken lines in FIGS. 4 and 5, to the vertical position by means of a moving magnet 58, and to return the pull-in mechanism 59 to the original position. Before the cross members 60a, 60b are returned to the horizontal position with the aid of the moving magnet 58 in order to pull in another magazine, the next magazine must be placed in the waiting position to ensure that the trays are loaded in a continuous sequence. This can be done, for example, with the aid of a conveyor belt (not shown).

The magazine 24c, which has just been introduced into the distributing apparatus, is first lifted by the lower driving-wheel pair 52a, 52b, as shown in FIGS. 5 and 6. To do this, the driving pins 53 of the driving wheels engage the engaging angles 29a, 29b attached to both sides of the uppermost tray . In this phase, as shown in FIG. 4, the magazine is restrained by the positioning strip 65 and cannot slide out of place. As soon as the first pair of driving pins 53 in in full engagement with the corresponding engaging angles 29—about halfway up the driving-wheel pair 52a, 52b—the guide portion 28 of the uppermost tray with the number 1 is moved into the L-shaped guide strips 46, 47, which begin at this point. The magazine 24c is now hanging with its uppermost pair of engaging angles 29a, 29b on the driving pins 53 in the distributing apparatus. At that instant, the magazine is restrained and partly supported by the first guide portion 28, which is already in the guide strips 46, 47, and by the positioning plate 67. Since that magazine no longer requires any lateral support in this section, the positioning strip 65 ends about halfway up the driving-wheel pair 52a, 52b. By the rotary motion of the driving system in the direction of the arrow 73, the magazine is then moved on, via its guide portions 28, through the still straight portion of the guide strips 46, 47. Immediately after a tray has moved with its guide portion 28 into the curved area of the guide strips, it is separated from the following tray as its lock 23 is unlocked by the unlocking mechanism 41, as can be seen in FIG. 3. In this phase, the individual unlocked trays are automatically spread at a given angle and thus open up like a fan since they are always perpendicular to the guide strips 46, 47 because of the guide portion 28 being exactly adapted to the guide strips 46, 47. The opened magazine is held together by the flexible tape 27 attached to the side opposite the lock 23.

Figure 7:
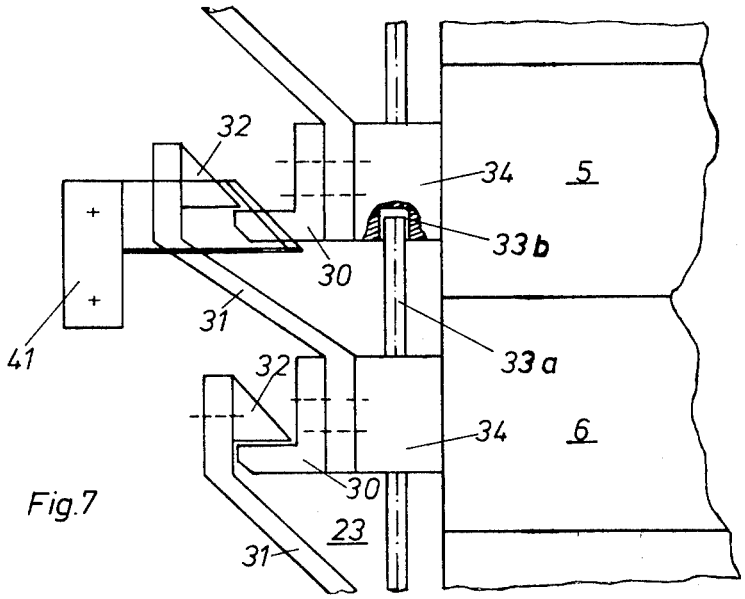
FIG. 7 is a side view of the unlocking mechanism.
Figure 8:
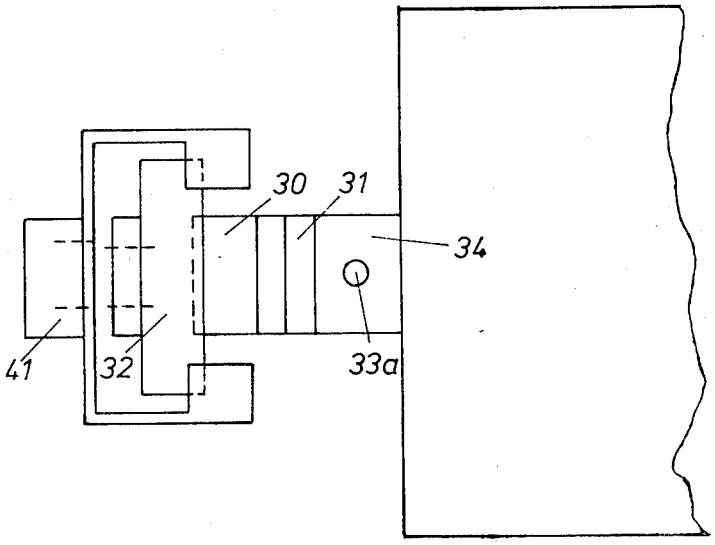
FIG. 8 is a top view of the unlocking mechanism.

The locks 23 of the trays are unfastened by the unlocking mechanism 41 attached to the frame plate 38 by means of a holder 42. FIGS. 7 and 8 show a lock with the associated unlocking mechanism in a side view and a top view, respectively.

Each lock 23 attached to a distance piece 34 is composed of a locking angle 30 and a tension spring 31, the latter carrying a locking hook 32 of triangular section at its free end. One locking angle 30 and one tension spring 31 are attached to each distance piece 34. When the trays are closed, as shown in FIG. 7, the locking hook 32 of the tray 6, which hook is attached to the tension spring 31, engages the locking angle 30 of the subsequent tray 5 and is held in place by the tension spring 31.

To unlock the trays, their locks are moved past the unlocking mechanism 41. This unlocking mechanism is formed, in principle, by an inclined plane via which the locking hook 32 of the tension spring 31 is guided during its upward movement, thereby being forced out of the locking angle 30 of the next tray, as shown in FIGS. 7 and 8.

After passing the unlocking mechanism 41, the unlocked trays move with their guide portions 28 into the curved portion of the guide strips 46, 47. When the tray 1, for example, reaches the position shown in FIG. 3 during the movement of the magazine 24a through the circular curvature of the guide strips, the outer engaging angle 29b of the tray 1 actuates a switch 69 mounted on a holder 72. The holder 72 with the switch 69 as well as the recognition of the tray and magazine numbers 35a, 35b are shown in detail in FIGS. 3, 5 and 6. As soon as the switch 69 is actuated, the motion of the magazine is interrupted. The tray 1 is in the loading position. In this position, the tray number 35a, stuck on the tray in coded form, is identified by the diode matrix 63 attached to the holder 72.

The information carriers sorted from a packet according to different criteria are first collected in a stack in front of the loading device 56 and simultaneously counted. After all information carriers of a packet which have not met given criteria have been collected, they are stacked in a tray of the distributing apparatus with the aid of the loading device 56. After the tray 1, for example, has been loaded, this is registered by a photoelectric device 71 attached to the frame plate 38 and giving the instruction to move the magazine on. The movement is not interrupted again until the tray 2 has taken up the position of the tray 1 shown in FIG. 3. In the same manner, all trays are guided past the loading station 56.

As the guide portions 28 of the trays are gradually moving into the downward, straight portion of the guide strips, which is directed toward the delivery table 44, the angle between the trays is decreasing until the trays are finally forced into the horizontal position in the straight portion of the guide strips and close altogether. At the same time, the locking hooks 32 are forced over the locking angles 30 of the subsequent trays and snap shut.

Unlike the unlocking of the trays, the locking of the same is done without any external device and uses only the above-described principle on which the guide portions 28 are guided in the guide strips 46, 47.

When the last tray 21, in which the handle 25 of the magazine is accommodated, has reached the position of the tray 1 shown in FIG. 3, the magazine number 35*b* applied in coded form to the tray 21 is identified via an additional diode matrix 70, which is also attached to the holder 72.

When the greater part of the loaded magazine is in the downward portion of the guide strips 46, 47, it is prevented by a brake 74, shown in detail in FIG. 6, from dropping due to its dead weight. A drop of the magazine would disturb the sequence of motions because the engaging angles 29*a*, 29*b*, which are in engagement with the driving pins 53 at one end only, would move away from the driving pins in an uncontrolled fashion and, in the worst case, would not engage the driving pins again until the latter have covered the distance between two engaging angles 29*a*, 29*b*. For this reason, the magazine is locked in the loading position by means of the brake 74. This is done by means of a tension spring 75 (FIG. 6) which is attached to the guide strips 46, 47 and has a brake block 76 secured thereto which is thus disposed between the guide strips 46, 47. A gap 78 between the guide strips 46, 47 and the brake block 76 is dimensioned so that the guide portion 28 passing through this gap must push back the brake block 76 against the force of the tension spring 75 and, thus, is clamped in place itself so as to be prevented from dropping due to the magazine's dead weight. On the other hand, the force of the tension spring 75 must allow the guide portion and, thus, the magazine to be moved by the driving system. As soon as the individual guide portions 28 have passed through the brake 74 and, thus, the guide strips 46, 47, they are guided by a guide plate 77 which begins directly under the brake block 76 of the brake 74 and stands vertically on the delivery table 44. The guide plate 77 ensures a vertical descent of the magazine.

Having passed through the driving system, the magazine moves onto the delivery table 44, where its bottommost tray actuates a switch 57 (FIG. 3). As a result, a delivery mechanism 68 is caused, via a pneumatic cylinder (not shown), to eject the magazine. As soon as the magazine has left the delivery table 44, it can be transported away to a remote station, e.g. on a conveyor belt, for processing the tray contents.

What is claimed is:

1. A distributing apparatus for continuously collecting sheet-like information carriers in numbered trays united in a magazine which are successively guided past a loading station, moving along an arcuately and narrowly curved guide opposite the loading station, opening up automatically, and, after leaving the curved guide, closing automatically, the cover of each tray being formed by the bottom of the tray lying on top of it, characterized in that the distributing apparatus comprises a receiving unit (43), a driving unit (45) and a delivery unit (44) whereby coded and transportable magazines (24) having a given number of lockable and coded trays (1–21) connected to each other by a movable connection are continuously received from a waiting position, and whereby the trays (1–21) of the magazines are unlocked, guided on a guide one after the other past the loading station (56), loaded, locked again, and delivered to a remote station from the distributing apparatus for subsequent processing, the trays each having a lock for positively locking each tray to a succeeding tray in the magazine and wherein a record is drawn up during the loading of the magazines and is delivered to the remote station which receives the magazines.

2. A distributing apparatus as claimed in claim 1, characterized in that the guide is a U-shaped guide strip with an open end directed downwardly and which consists of two individual L-section strips (46, 47) extending parallel to each other forming a guideway.

3. A distributing apparatus as claimed in claim 2, characterized in that the movable connection between the trays consists of a flexible tape (27) connected with the trays of T-shaped guide portions (28) sliding through the guideway in the L-section strips (46, 47) during the transport of the magazine (24).

4. A distributing apparatus as claimed in claim 3, characterized in that the L-section strips (46, 47) are so arranged relative to each other as to be accurately adapted to the T-shaped guide portions (28) of the trays.

5. A distributing apparatus as claimed in claim 1, characterized in that each lock (23) consists of a locking angle (30) provided at one tray, of a tension spring (31) provided at the succeeding tray, and of a locking hook (32).

6. A distributing apparatus as claimed in claim 5, characterized in that to unlock the individual trays (1–21) of the magazine, the upwardly directed path of the magazine includes an inclined plane (41) along which each locking hook (32) slides.

7. A distributing apparatus as claimed in claim 3, characterized in that an engaging angle (29*a*, 29*b*) is provided at each of the two side surfaces of each tray near the guide portions (28) thereof.

8. A distributing apparatus for collecting information carriers comprising: a plurality of trays movably connected to each other, each movable from a covered position with respect to an adjacent tray, to an uncovered position; locking means connected to said trays for positively locking said trays to each other in their covered positions to form a magazine which is transportable as a unit; guide means engageable with said magazine for guiding said trays in a feed path past a loading station, said guide means having a curved portion to move said trays into their uncovered positions in the vicinity of said loading station; said locking means relocking said trays to each other downstream of said loading station in said feed path; loading means at said loading station for supplying at least one information carrier to at least one of said trays in its uncovered position; unlocking means engageable with said locking means of said trays in said feed path for unlocking said trays from each other upstream of said curved portion; and drive means engageable with said magazine to drive trays along said feed path.

9. A distributing apparatus according to claim 8 wherein said trays are pivotally mounted to each other along one side of said magazine and said trays have respective portions engageable with said guide means, each of said locking means for locking each of said trays being on an opposite side of said magazine.

10. A distributing apparatus according to claim 9 wherein each of said respective positions of said trays comprise a T-shaped member connected to said trays on said one side of said magazine, said guide means comprising a channel for receiving each of said T-shaped members.

11. A distributing apparatus according to claim 9 wherein each of said trays includes an angle member on each side thereof, said drive means comprising a pair of wheels rotatably mounted adjacent said guide means, each wheel having a plurality of pins engageable with said angle members of said trays, and a shaft connected to said wheels for rotating said wheels and moving said trays along said feed path.

12. A distributing apparatus according to claim 9 wherein each of said locking means comprises a locking angle connected to each of said trays and a locking hook connected to each of said trays through a tension spring, each of said locking hooks of one tray engaged with a locking angle of an adjacent tray downstream of said feed path to lock said adjacent trays to each other.

13. A distributing apparatus according to claim 12 wherein said unlocking means comprises an inclined member extending in the path of said locking hooks to disengage each of said locking hooks from each of said locking angles,

14. A distributing apparatus according to claim 12 further including a distance piece connected between each of said trays and each of said associated locking angles, each distance piece having a bore on one side thereof and a pin extending from an opposite side thereof engageable into a bore of a subsequent tray in said magazine whereby said trays are aligned with each other in their locked position.

15. A distributing apparatus according to claim 10 further including a feed table for receiving a magazine, a pull-in mechanism for moving said magazine on said feed table into a position of engagement with said drive means.

16. A distributing apparatus according to claim 15 further including a positioning strip engageable with said magazine as it is moved by said pull-in mechanism to align each of said trays with said guide means.

* * * * *